US007647979B2

(12) United States Patent
Shipley et al.

(10) Patent No.: US 7,647,979 B2
(45) Date of Patent: Jan. 19, 2010

(54) DOWNHOLE ELECTRICAL POWER GENERATION BASED ON THERMO-TUNNELING OF ELECTRONS

(75) Inventors: Frederick E. Shipley, Houston, TX (US); Rocco DiFoggio, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 271 days.

(21) Appl. No.: 11/087,361

(22) Filed: Mar. 23, 2005

(65) Prior Publication Data

US 2006/0213669 A1 Sep. 28, 2006

(51) Int. Cl.
*E21B 36/00* (2006.01)

(52) U.S. Cl. ..... 166/381; 166/302; 166/65.1; 310/306

(58) Field of Classification Search ..... 166/302, 166/60, 381, 65.1, 104; 310/306, 307; 290/1 R; 136/205
See application file for complete search history.

(56) References Cited

U.S. PATENT DOCUMENTS

| | | | | | |
|---|---|---|---|---|---|
| 3,169,200 | A | * | 2/1965 | Huffman | 310/306 |
| 4,375,157 | A | | 3/1983 | Boesen | 64/514 R |
| 5,248,896 | A | | 9/1993 | Forrest | 290/1 R |
| 5,623,119 | A | * | 4/1997 | Yater et al. | 136/225 |
| 5,675,972 | A | | 10/1997 | Edelson | |
| 5,699,668 | A | | 12/1997 | Cox | |
| 5,722,242 | A | | 3/1998 | Edelson | |
| 5,732,776 | A | | 3/1998 | Tubel et al. | 166/250.15 |
| 5,839,508 | A | | 11/1998 | Tubel et al. | 166/65.1 |
| 5,874,039 | A | | 2/1999 | Edelson | |
| 5,929,372 | A | * | 7/1999 | Oudoire et al. | 136/208 |
| 5,931,000 | A | | 8/1999 | Turner et al. | 62/3.2 |
| 5,939,667 | A | * | 8/1999 | Oudoire et al. | 136/205 |
| 5,981,071 | A | | 11/1999 | Cox | |
| 5,994,638 | A | | 11/1999 | Edelson | |
| 6,011,346 | A | | 1/2000 | Buchanan et al. | 310/339 |
| 6,064,137 | A | | 5/2000 | Cox | |
| 6,089,311 | A | | 7/2000 | Edelson | |
| 6,103,298 | A | | 8/2000 | Edelson et al. | |
| 6,117,344 | A | | 9/2000 | Cox et al. | |
| 6,134,892 | A | | 10/2000 | Turner et al. | 62/3.2 |
| 6,150,601 | A | * | 11/2000 | Schnatzmeyer et al. | 136/201 |
| 6,214,651 | B1 | | 4/2001 | Cox | |
| 6,253,847 | B1 | | 7/2001 | Stephenson | 166/248 |
| 6,281,139 | B1 | | 8/2001 | Tavkhelidze et al. | |
| 6,281,514 | B1 | | 8/2001 | Tavkhelidze | |
| 6,380,476 | B1 | * | 4/2002 | Heijnen et al. | 136/208 |
| 6,554,074 | B2 | | 4/2003 | Longbottom | 166/372 |
| 6,717,283 | B2 | | 4/2004 | Skinner et al. | 290/43 |
| 6,768,214 | B2 | | 7/2004 | Schultz et al. | 290/1 R |
| 7,262,360 | B1 | * | 8/2007 | Davis | 136/205 |
| 2006/0207643 | A1 | * | 9/2006 | Weaver et al. | 136/205 |
| 2006/0226731 | A1 | * | 10/2006 | Rider | 310/306 |
| 2007/0053394 | A1 | * | 3/2007 | Cox | 372/34 |

* cited by examiner

OTHER PUBLICATIONS

Deprez et al.; *Energy Efficiency of small Induction Machines: Comparison between Motor and Generator Mode*, International Council On Large Electrical Systems, Paris, May 12, 2006.

*Primary Examiner*—David J Bagnell
*Assistant Examiner*—Robert E Fuller
(74) *Attorney, Agent, or Firm*—Madan & Sriram, P.C.

(57) ABSTRACT

An apparatus for and a method of generating electrical power downhole using a quantum thermoelectric generator and operating a downhole device using the generated power.

21 Claims, 7 Drawing Sheets

DOWNHOLE ELECTRICAL POWER GENERATION BASED ON THERMO-TUNNELING OF ELECTRONS

CROSS REFERENCES TO RELATED APPLICATIONS

This application is related to a United States patent application filed on concurrently with the present application entitled "Downhole Cooling Based on Thermo-tunneling of Electrons" under Ser. No. 11/087,362 having the same inventors as the present application.

BACKGROUND OF THE INVENTION

1. Field of the Invention

This present invention relates to an apparatus for and a method of generating electrical power in a downhole environment. It may be used in wireline applications, measurement-while-drilling (MWD) applications, and in a producing borehole.

2. Background of the Invention

In underground drilling applications, such as oil and gas exploration and development, a borehole is drilled through a formation deep in the earth. Such boreholes are drilled or formed by a drillbit connected to an end of a series of sections of drill pipe, so as to form an assembly commonly referred to as a "drillstring." The drillstring extends from the Earth's surface to the bottom of the bore hole. As the drillbit rotates, it advances into the earth, thereby forming the borehole. In order to lubricate the drill bit and flush cuttings from its path as it advances, a high pressure fluid, referred to as "drilling mud," is directed through an internal passage in the drillstring and out through the drill bit. The drilling mud then flows to the surface through an annular passage formed between the exterior of the drillstring and the surface of the bore.

The distal or bottom end of the drillstring, which includes the drillbit, is referred to as a bottomhole assembly (BHA). In addition to the drillbit, the BHA often includes specialized modules or tools within the drillstring that make up the electrical system for the drillstring. Such modules often include sensing modules, a control module and a pulser module. In many applications, the sensing modules provide the drillstring operator with information regarding the formation as it is being drilled through, using techniques commonly referred to as "measurement while drilling" (MWD) or "logging while drilling" (LWD). For example, resistivity sensors may be used to transmit and receive high frequency signals (e.g., electromagnetic waves) that travel through the formation surrounding the sensor.

In other applications, sensing modules are utilized to provide data concerning the direction of the drilling and can be used, for example, to control the direction of a steerable drillbit as it advances. Steering sensors may include a magnetometer to sense azimuth and an accelerometer to sense inclination. Signals from the sensor modules are typically received and processed in the control module of the downhole tool. The control module may incorporate specialized electronic components to digitize and store the sensor data. In addition, the control module may also direct the pulser modules to generate acoustic pulses within the flow of drilling fluid that contain information derived from the sensor signals. These pressure pulses are transmitted to the surface, where they are detected and decoded, thereby providing information to the drill operator. In view of the limited bandwidth of telemetry channels available in MWD environments, it is common practice to have a downhole processor that processes the measurements made by the sensors and also controls the direction of drilling.

It will be appreciated that the sensors and processors require a considerable amount of electrical power. In addition, power may also be required for drilling operations over and above the power of the rotating drillstring.

After the well has been drilled, additional measurements are made using sensors conveyed on a wireline or coiled tubing. These sensors are used for obtaining additional measurements of properties of the earth formation. Power requirements for wireline applications are usually met by transmitting power through the wireline. There are certain applications that will be discussed later that require high levels of power. It will be appreciated that when power is transmitted through a wireline that may be several kilometers in length, cable resistance can become an important limitation on the amount of power that can be transmitted downhole. For these high power requirements, it would be desirable to have an auxiliary power source downhole.

The control of oil and gas production wells constitutes an important and on-going concern of the petroleum industry. Production well control has become particularly important and more complex in view of the industry wide recognition that wells having multiple branches (i.e., multilateral wells) will be increasingly important and commonplace. Such multilateral wells include discrete production zones which produce fluid in either common or discrete production tubing. In either case, there is a need for controlling zone production, isolating specific zones and otherwise monitoring each zone in a particular well. As a result, the methods and apparatus for controlling wells are growing more complex and in particular, there is an ever increasing need for downhole control systems which include downhole computerized modules employing downhole computers (e.g., microprocessors) for commanding downhole tools such as packers, sliding sleeves and valves. An example of such a sophisticated downhole control system is disclosed in U.S. Pat. No. 5,732,776 to Tubel et al., which is assigned to the assignee hereof and incorporated herein by reference. Tubel discloses downhole sensors, downhole electromechanical devices and downhole computerized control electronics whereby the control electronics automatically control the electromechanical devices based on input from the downhole sensors. Thus, using the downhole sensors, the downhole computerized control system will monitor actual downhole parameters (such as pressure, temperature, flow, gas influx, etc.) and automatically execute control instructions when the monitored downhole parameters are outside a selected operating range (e.g., indicating an unsafe condition). The control devices and the processors also require a reliable source of power.

A variety of methods have been used for downhole generation of power. U.S. Pat. No. 5,839,508 to Tubel et al., having the same assignee as the present invention and the contents of which are fully incorporated herein by reference, teaches the use of an electrical generator that produces electricity from the flow of fluids in a production well. U.S. Pat. No. 6,554,074 to Longbottom teaches the use of electrical power generation using lift fluid in a producing well. U.S. Pat. No. 6,717,283 to Skinner et al. teaches a generator that derives its power from changes in annulus pressure in a producing borehole. U.S. Pat. No. 6,253,847 to Stephenson discloses electrolytic power generation wherein the casing is used as an electrode. U.S. Pat. No. 6,011,346 to Buchanan et al. and U.S. Pat. No. 6,768,214 to Schultz et al. disclose the use of piezoelectric generation of electricity that ultimately derives power from the motion of flowing fluids in a producing well. One drawback of the methods that rely on fluid flow for electric power generation is that they obviously cannot be used for wireline applications. In addition, the power outputs are limited and, being mechanical devices, the efficiency is generally low.

U.S. Pat. No. 5,248,896 to Forrest having the same assignee as the present invention and the contents of which are fully incorporated herein by reference, teaches the use of an electrical generator that is coupled to a mud motor. Like the other methods discussed above, such devices are inapplicable to wireline applications. In addition, the power output is limited by the rate of mud flow, and the efficiency is generally low. Furthermore, since the generator is coupled to the mud motor, electrical power is generated at the cost of power available at the drillbit.

One of the problems encountered in downhole applications is high temperatures. The rate of increase in temperature per unit depth in the earth is called the geothermal gradient. The geothermal gradient varies from one location to another, but it averages 25 to 30° C./km. Thus, at a well depth of 6 km, the temperature could be close to 200° C. Electronic circuitry and processors are usually not capable of operating above 175° C. Accordingly, there is extensive prior art in cooling methods for downhole use. Included in the cooling methods is thermoelectric cooling.

In the most general sense, thermoelectricity can be defined as the conversion of temperature differences to electricity and vice-versa. Two traditional examples of thermoelectricity are the Peltier-Seebeck effect (thermocouples) and thermionic conversion (heating a material to release electrons). A third, non-traditional example of thermoelectricity is thermotunneling in which electrons can quantum-mechanically tunnel from one unheated material to another when the distance between the two materials is small enough. FIG. 2*a* is a circuit representation of a thermionic cooler. FIG. 2*b* is a schematic representation of a thermionic cooler. A voltage source 205 is connected to a collector 201 and an emitter 207 of electrons 203. Under certain conditions, a temperature difference results due to heat 221 being extracted from the collector and the emitter is cooled.

U.S. Pat. No. 4,375,157 to Boesen, includes traditional thermoelectric coolers that are powered from the surface. The thermoelectric coolers transfer heat from the electronics area within a Dewar flask to the well fluid by means of a vapor phase heat transfer pipe. U.S. Pat. No. 5,931,000 and U.S. Pat. No. 6,134,892 to Turner et al. discloses a system in which traditional thermoelectric cooling is used as part of a cascaded cooling system.

Thermoelectric power generation uses the same principles as thermoelectric cooling and is illustrated in FIGS. 2*c* and 2*d*. Shown is an emitter 257 that is heated so as to have a higher temperature than the collector 251. Electrons 253 move from the emitter to the collector, generating a current that flows through the load 255. Unlike thermoelectric cooling, we are not aware of any prior art using thermoelectric power generation for downhole applications. A large part of the problem lies in the difficulty of fabricating thermoelectric power generators, their low efficiencies and relatively low power output.

It would be desirable to have a method and apparatus for generating electrical power downhole that is flexible, has high efficiency and is capable of high power output. The present invention satisfies this need.

SUMMARY OF THE INVENTION

One embodiment of the present invention is a system for use in a borehole in an earth formation. The system includes a thermoelectric generator that produces electrical power in response to a difference of temperature between a first side of the generator and a second side of the generator. The thermoelectric generator may be a quantum thermoelectric generator (QTG). The system also includes a downhole device operated by the electrical power. The borehole may be a producing borehole, in which case, the downhole device may be a flow control device, a packer, a choke, a perforating device, an anchor, a completion device, and/or a production device. The QTG includes an emitter and a collector which may be spaced less than about 20 nm apart. The QTG may be conveyed into the borehole on a wireline, a drillstring, and/or coiled tubing. When the QTG is conveyed on a drillstring or coiled tubing, one side of the QTG is in contact with a fluid between a downhole assembly and the borehole wall and the other side of the QTG is in contact with a fluid inside the downhole assembly. The system may include a phase change material enclosed within an insulating container, and a thermally conductive element coupling the phase change material to the first side of the QTG. In one embodiment of the invention, the temperature difference may be maintained by using a tubular that has a first portion with a first thermal conductivity insulated from a second portion with a different thermal conductivity. The device may be a nuclear magnetic resonance device, a coring device, a formation fluid sampling device, and/or a resistivity measuring device.

Another embodiment of the invention is a method of performing operations in a borehole in an earth formation. The method includes producing electrical power by positioning a quantum thermoelectric generator (QTG) where there is a difference of temperature between a first side of the QTG and a second side of the QTG, and operating a downhole device using the electrical power. The downhole device may be flow control device, a packer, a choke, a perforating device, an anchor, a completion device, a downhole sensor and/or a production device. The first and second sides of the QTG comprise an emitter and a collector, which may be at a spacing of less than about 20 nm. The QTG may be part of a downhole assembly and the method includes conveying the downhole assembly into the borehole on a wireline, drillstring or coiled tubing. One side of the QTG may be contact with a fluid on the inside of the downhole assembly and the other side of the QTG may be in contact with a fluid between the downhole assembly and the borehole wall. The downhole assembly may include a phase change material that is in thermal contact with one side of the QTG. Operation may be carried out either from the surface down or from the bottom up.

BRIEF DESCRIPTION OF THE FIGURES

The application is best understood with reference to the following drawings wherein like numbers in different figures refer to like components and in which.

DETAILED DESCRIPTION OF THE INVENTION

Figure 1:
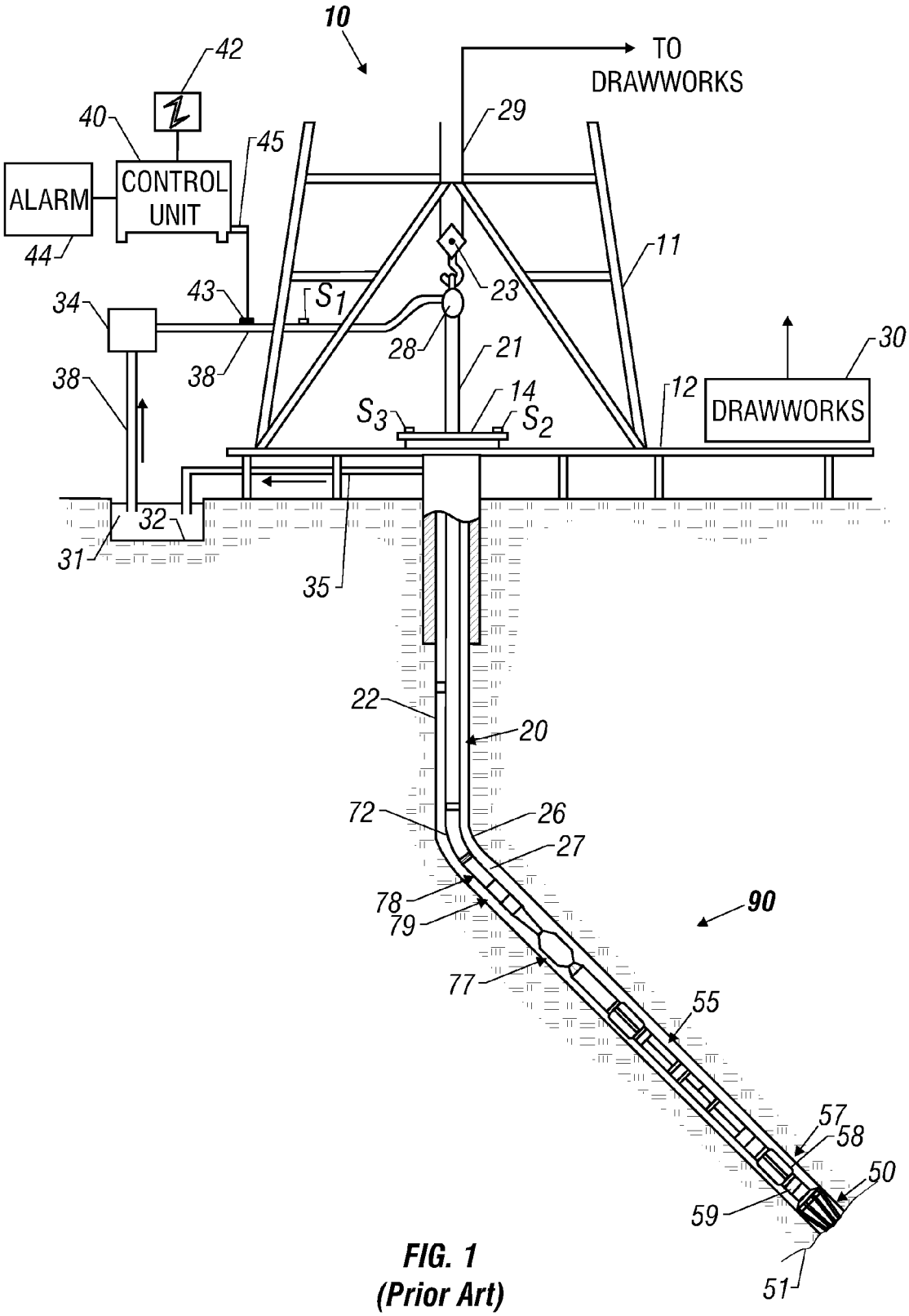
FIG. 1 (Prior Art)
FIG. 1 shows a schematic diagram of a drilling system that employs the apparatus of the current invention in a measurement-while-drilling embodiment.
Figure 2B:
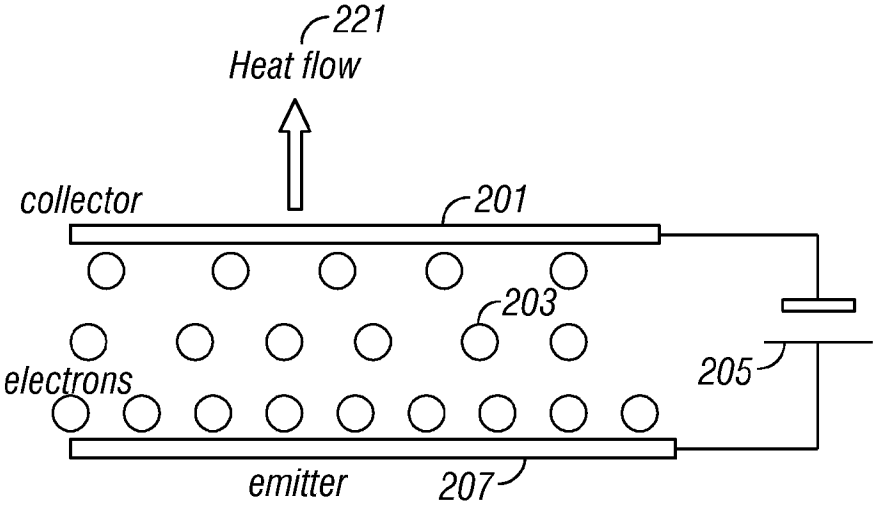
FIG. 2B (Prior Art)
FIG. 2*b* (prior art) is a schematic representation of a thermionic cooler.
Figure 2A:
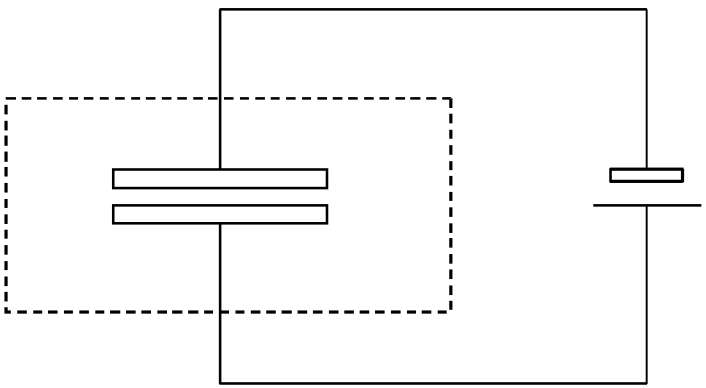
FIG. 2A (Prior Art)
FIG. 2*a* (prior art) is a circuit representation of a thermionic cooler.
Figure 2D:
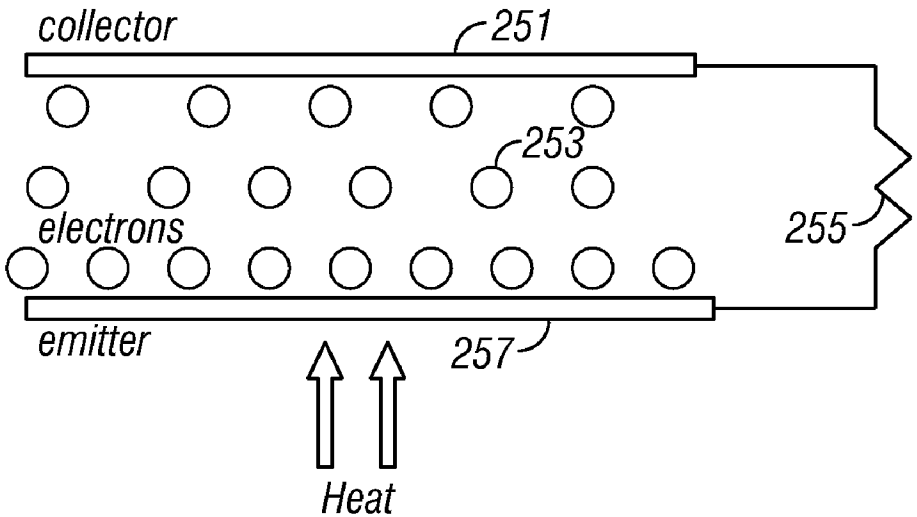
FIG. 2D (Prior Art)
FIG. 2*d* (prior art) is a schematic representation of a thermionic power generator.
Figure 2C:
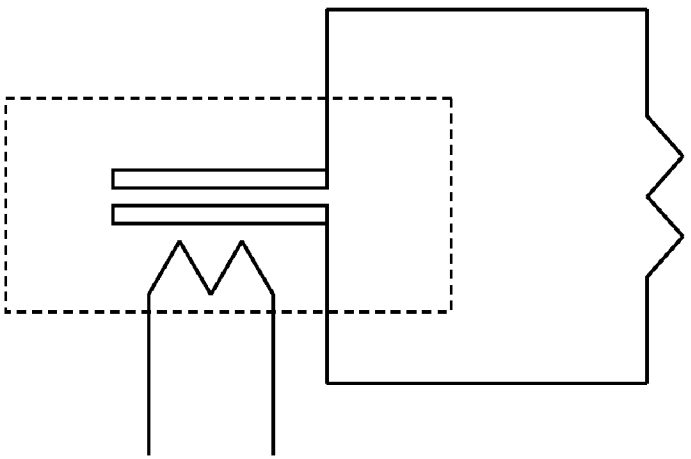
FIG. 2C (Prior Art)
FIG. 2*c* (prior art) is a circuit representation of a thermionic power generator.

The present invention is first described with reference to a measurement-while-drilling application. FIG. 1 shows a schematic diagram of a drilling system 10 with a drillstring 20 carrying a drilling assembly 90 (also referred to as the bottomhole assembly, or "BHA") conveyed in a "wellbore" or "borehole" 26 for drilling the wellbore. The drilling system 10 includes a conventional derrick 11 erected on a floor 12 which supports a rotary table 14 that is rotated by a prime mover such as an electric motor (not shown) at a desired rotational speed. The drillstring 20 includes a tubing such as a drill pipe 22 or a coiled-tubing extending downward from the surface into the borehole 26. The drillstring 20 is pushed into the wellbore 26 when a drill pipe 22 is used as the tubing. For coiled-tubing applications, a tubing injector, such as an injector (not shown), however, is used to move the tubing from a source thereof, such as a reel (not shown), to the wellbore 26. The drill bit 50 attached to the end of the drillstring breaks up the geological formations when it is rotated to drill the borehole 26. If a drill pipe 22 is used, the drillstring 20 is coupled to a drawworks 30 via a Kelly joint 21, swivel, 28 and line 29 through a pulley 23. During drilling operations, the drawworks 30 is operated to control the weight on bit, which is an important parameter that affects the rate of penetration. The operation of the drawworks is well known in the art and is thus not described in detail herein.

During drilling operations, a suitable drilling fluid 31 from a mud pit (source) 32 is circulated under pressure through a channel in the drillstring 20 by a mud pump 34. The drilling fluid passes from the mud pump 34 into the drillstring 20 via a desurger 36, fluid line 28 and Kelly joint 21. The drilling fluid 31 is discharged at the borehole bottom 51 through an opening in the drill bit 50. The drilling fluid 31 circulates uphole through the annular space 27 between the drillstring 20 and the borehole 26 and returns to the mud pit 32 via a return line 35. The drilling fluid acts to lubricate the drill bit 50 and to carry borehole cutting or chips away from the drill bit 50. A sensor $S_1$ preferably placed in the line 38 provides information about the fluid flow rate. A surface torque sensor $S_2$ and a sensor $S_3$ associated with the drillstring 20 respectively provide information about the torque and rotational speed of the drillstring. Additionally, a sensor (not shown) associated with line 29 is used to provide the hook load of the drillstring 20.

In one embodiment of the invention, the drill bit 50 is rotated by only rotating the drill pipe 22. In another embodiment of the invention, a downhole motor 55 (mud motor) is disposed in the drilling assembly 90 to rotate the drill bit 50 and the drill pipe 22 is rotated usually to supplement the rotational power, if required, and to effect changes in the drilling direction.

In the preferred embodiment of FIG. 1, the mud motor 55 is coupled to the drill bit 50 via a drive shaft (not shown) disposed in a bearing assembly 57. The mud motor rotates the drill bit 50 when the drilling fluid 31 passes through the mud motor 55 under pressure. The bearing assembly 57 supports the radial and axial forces of the drill bit. A stabilizer 58 coupled to the bearing assembly 57 acts as a centralizer for the lowermost portion of the mud motor assembly.

In one embodiment of the invention, a drilling sensor module 59 is placed near the drill bit 50. The drilling sensor module contains sensors, circuitry and processing software and algorithms relating to the dynamic drilling parameters. Such parameters preferably include bit bounce, stick-slip of the drilling assembly, backward rotation, torque, shocks, borehole and annulus pressure, acceleration measurements and other measurements of the drill bit condition. A suitable telemetry or communication sub 72 using, for example, two-way telemetry, is also provided as illustrated in the drilling assembly 100. The drilling sensor module processes the sensor information and transmits it to the surface control unit 40 via the telemetry system 72.

The communication sub 72, a power unit 78 and an MWD tool 79 are all connected in tandem with the drillstring 20. Flex subs, for example, are used in connecting the MWD tool 79 in the drilling assembly 90. Such subs and tools form the bottom hole drilling assembly 90 between the drillstring 20 and the drill bit 50. The drilling assembly 90 makes various measurements including the pulsed nuclear magnetic resonance measurements while the borehole 26 is being drilled. The communication sub 72 obtains the signals and measurements and transfers the signals, using two-way telemetry, for example, to be processed on the surface. Alternatively, the signals can be processed using a downhole processor in the drilling assembly 90.

The surface control unit or processor 40 also receives signals from other downhole sensors and devices and signals from sensors $S_1$-$S_3$ and other sensors used in the system 10 and processes such signals according to programmed instructions provided to the surface control unit 40. The surface control unit 40 displays desired drilling parameters and other information on a display/monitor 42 utilized by an operator to control the drilling operations. The surface control unit 40 preferably includes a computer or a microprocessor-based processing system, memory for storing programs or models and data, a recorder for recording data, and other peripherals. The control unit 40 is preferably adapted to activate alarms 44 when certain unsafe or undesirable operating conditions occur.

Figure 3A:
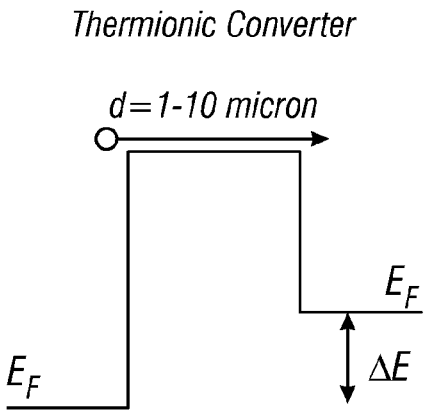
FIG. 3A (Prior Art)
FIGS. 3*a*-3*c* (prior art) and 3*d*-3*e* illustrate the principle of quantum tunneling.
Figure 3B:
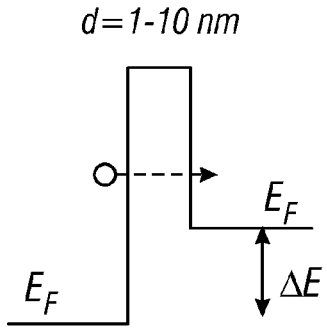
FIG. 3B (Prior Art)

The present invention relies on improved thermoelectric devices in which the phenomenon of quantum tunneling is used advantageously. If the two electrodes are close enough to each other, electrons do not need to jump over a barrier. This is illustrated schematically in FIG. 3*b* where an electron is shown tunneling through a potential barrier (the potential barrier being, for example, the work function of the electron source material). Under the laws of quantum mechanics, they can 'tunnel' from one side to another. This is contrast to classical mechanics as shown in FIG. 3*a* where the electron cannot get across the potential barrier unless its energy exceeds the height of the potential barrier. The differences between classical and quantum mechanics is further illustrated in FIGS. 3*c*-3*e*.

Figure 3C:
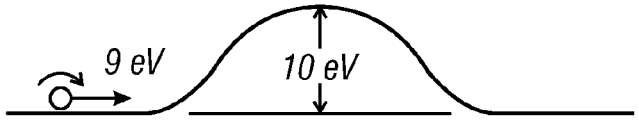
Figure 3D:
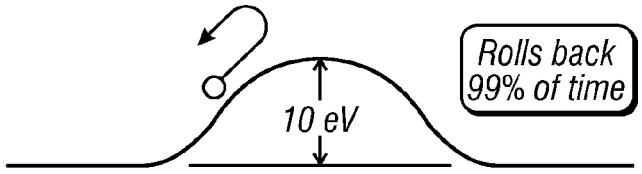
Figure 3E:
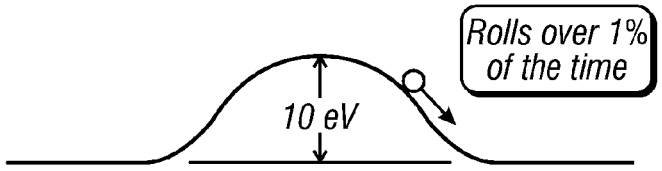

Depicted in FIG. 3*c* for illustrative purposes is an electron with an energy of say 9 eV approaching a barrier of height 10 eV. Under classical theory, the electron cannot go over the barrier FIG. 3*d* as the energy of the electron is less than the energy needed to go over the barrier. Under the laws of quantum mechanics, however, the electron is characterized by a distribution of waves having certain statistical properties. It is entirely possible that 99% of the time, the waves characterizing the electron are reflected back as the electron impinges on the barrier, but may actually tunnel through the barrier 1% of the time FIG. 3*e*. The numbers 99% and 1% are for illustrative purposes only, and the actual values in a particular situation would depend, among other things, upon the width of the barrier, and the height of the barrier.

In order for the quantum tunneling to take place and power generation to occur, the distance between the emitter and the collector in FIG. 3*c* should be on the order of 1-10 nm. An early device for thermoelectric power generation based on quantum tunneling is disclosed in U.S. Pat. No. 3,169,200 to Huffman. Taught therein is the use of a stack of emitters and collectors. The devices disclosed by Huffman operated at relatively high temperatures (of the order of 700° K) and involved materials that are difficult to fabricate and had high work functions. More recently, thermoelectric power devices based on quantum tunneling have become commercially available from Borealis Technical Limited under the mark PowerChips™. Such devices have been described in U.S. Pat. No. 6,531,703 to Tavkhelidze. The device may be referred to hereafter as a quantum thermoelectric generator (QTG).

Devices like PowerChips™ with spacings of the order of 1-10 nm have several advantages. First, they can be made of standard, low work function material. They can be operated at lower temperatures than prior devices. Higher efficiencies (up to about 55% of the Carnot limit) are possible. One application of QTGs has been discussed in S. Kilgrow et al. (International Geothermal Conference, Reykjavik, September 2003), where electrical power is generated at the surface from geothermal wells.

Figure 4:
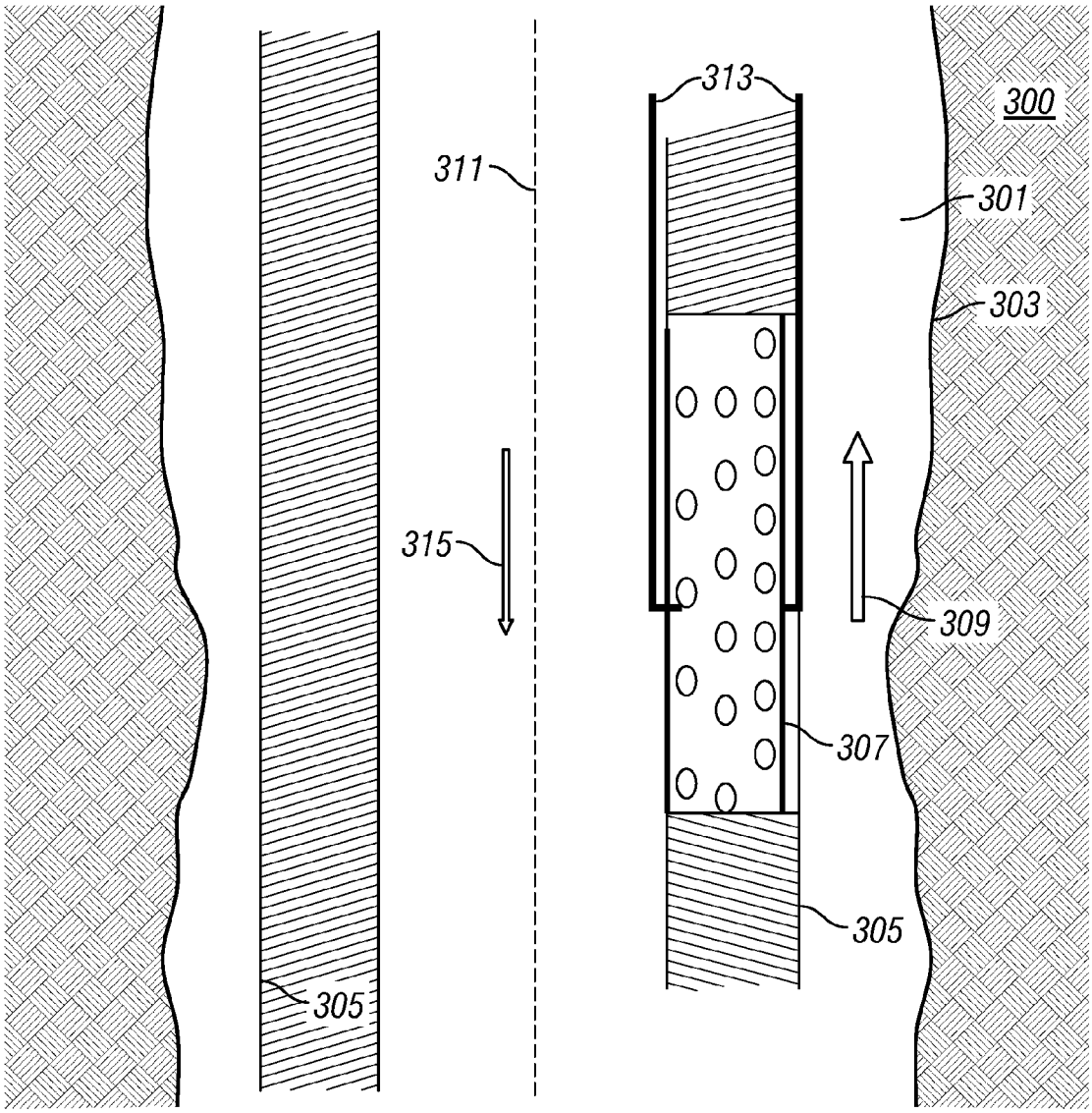
FIG. 4 is an illustration of one embodiment of the present invention for generating power based on the temperature difference between mud within a tubular and the mud in the annular space outside the tubular.

FIG. 4 illustrates one embodiment of the present invention of a QTG as used for downhole applications. Shown therein is an earth formation 300 having a borehole with wall 303. Conveyed in the borehole is a tubular 305. The tubular could be a drill collar that conveys a BHA into the borehole or it could be coiled tubing used for logging after drilling. The BHA and the apparatus conveyed downhole on coiled tubing (or wireline) may be collectively referred to as a downhole assembly. The axis of the tubular is denoted by 311. Fluid, called drilling mud, is conveyed through an inner bore of the tubular from a surface source (not shown). The flow of mud is denoted by 315. The return path of the mud is through the annulus 301 between the tubular 305 and the borehole wall 303.

The fluid within the tubular will be at a lower temperature than the fluid in the annulus. There are several reasons for this. First, the fluid in the annulus is in contact with the earth formation, a heat source. Secondly, for MWD operations, heat is generated by operation of the drillbit (not shown) and this generated heat is also carried away by the fluid in the annulus. The temperature difference, though it may be only a few degrees, is sufficient for operating a QTG. The prior art shows the use of conventional thermoelectric generators using a temperature difference of 2° C. as a power source for an implantable pacemaker. See U.S. Pat. No. 6,640,137 to Macdonald.

Also shown in FIG. 4 is a QTG 307 that exploits this temperature difference to produce electrical power. The QTG is electrically connected to a load (not shown) through leads 313. It should be noted that the embodiment of the invention shown in FIG. 4 may also be used in production wells where there is a fluid flow out of the earth formation at a higher temperature than the production system. The generated electrical power may be used to operate downhole devices such as (a) flow control device, (b) a packer, (c) a choke, (d) a perforating device, (e) an anchor, (f) a completion device, and (g) a production device, (h) a sensor, (i) a transducer.

Figure 5:
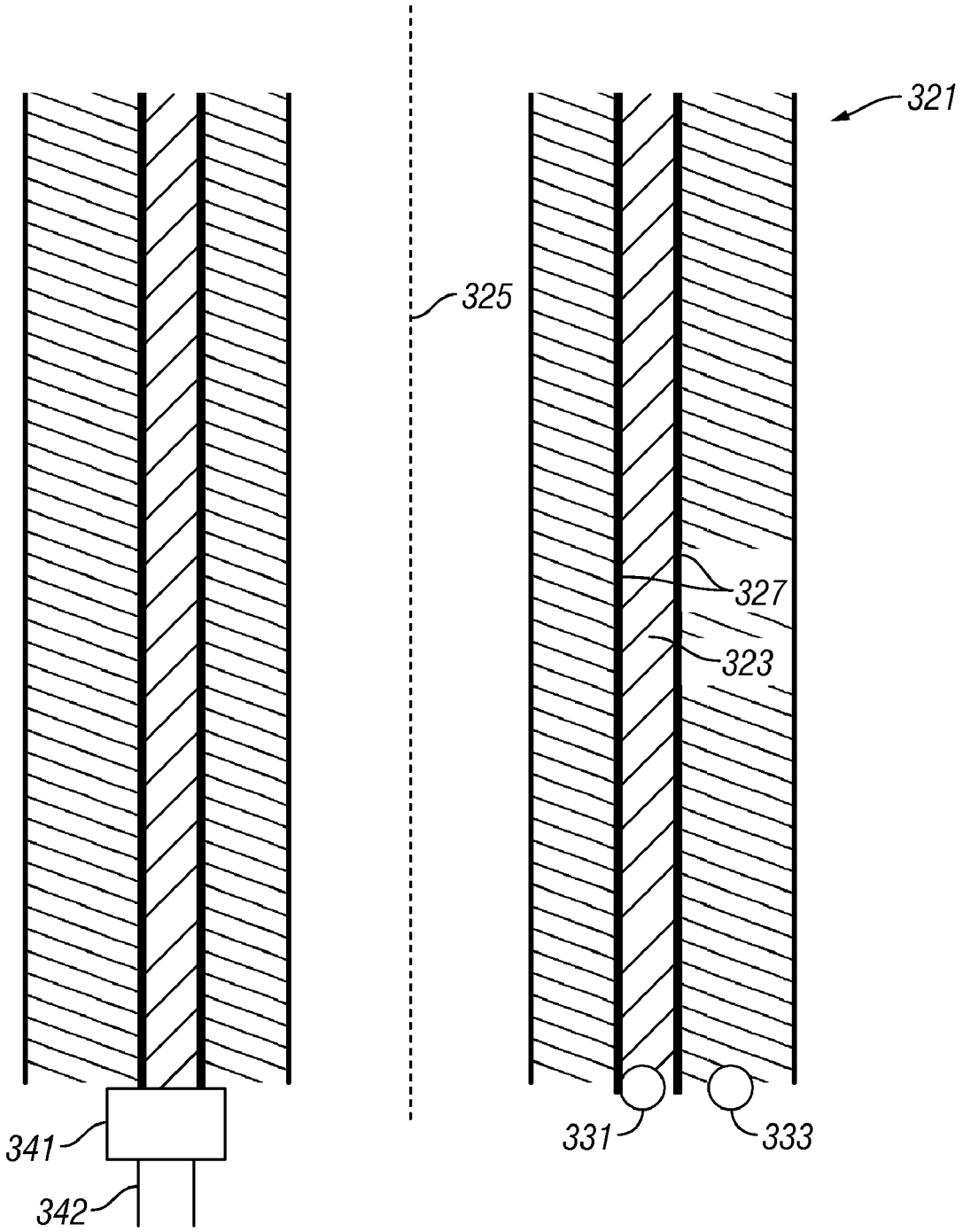
FIG. 5 shows how a specially constructed drill collar may be used to provide the temperature difference for a power generator according to the present invention.

FIG. 5 shows part of an embodiment of the invention whereby a temperature differential can be maintained without fluid flow. A specially made section of drillstring 321 having the axis 325 includes an inner core 323 that is made of metal with very high thermal conductivity. Insulating layers 327 thermally insulate the inner core 323 from the rest of the drill collar. Due to the normal temperature gradient in the borehole, the upper end of the drill collar will be at a lower temperature than the lower end of the drill collar. Due to the high thermal conductivity of the inner core, the bottom of the inner core 323 denoted by 331 will be at a lower temperature than an adjacent point 333 on the drill collar. This temperature difference can be used to drive a QTG 341 with an output 342.

Figure 6:
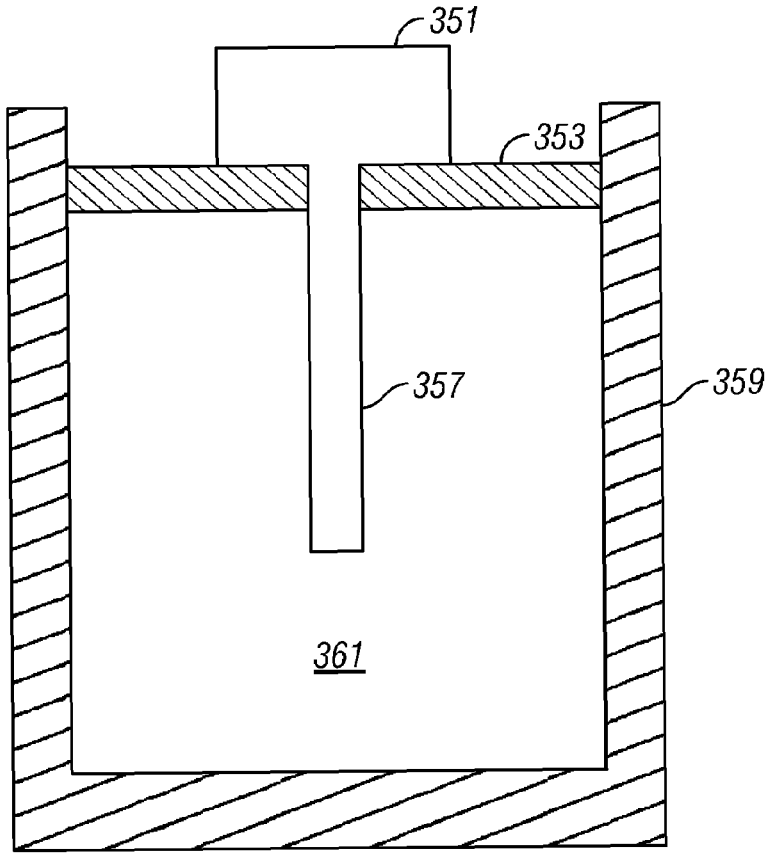
FIG. 6 shows an embodiment of the invention using a phase change material.

Turning now to FIG. 6, another embodiment of the invention suitable for wireline and MWD applications is shown. An insulating container such as a Dewar flask 359 contains a phase change material 361 within it. A downhole cooling system including such a phase change material has been disclosed in U.S. Pat. No. 6,341,498 to DiFoggio, having the same assignee as the present invention and the contents of which are incorporated herein by reference. A QTG 351 is insulated from the phase change material 361 by insulator 353. A conducting rod 357 couples the phase change material to one side of the QTG 351. The other side of the QTG is exposed to ambient temperature in the borehole.

The device may be used in two modes of operation. In a first mode, used when logging from the surface down, the phase change material is at a low temperature and in solid form. As it is lowered into the borehole, the temperature of the phase change material will be lower than the ambient temperature, so that the end of the QTG that is in contact with the conducting rod 357 would be the collector. In a second mode of operation, the assembly is lowered to the bottom of the borehole where the phase change material is molten. As the assembly is brought up the borehole, the temperature of the phase change material will be higher than the ambient borehole temperature, so that the end of the QTG in contact with the conducting rod would have to be the emitter.

The present invention envisages several versions of the apparatus shown in FIG. 5. In one version, the collector is coupled to the conducting rod and the apparatus can only be used when going down into the borehole. A second version has the emitter coupled to the conducting rod and the apparatus can only be used when coming out of the borehole In a third version of the borehole, two QTGs are provided, one with the collector in contact with the conducting rod and the other with the emitter in contact with the conducting rod. A fourth version of the invention has a mechanical arrangement for reorienting the QTG from a first orientation in which the collector is coupled to the phase change material to a second orientation in which the emitter is coupled to the phase change material.

We next discuss several applications of the QTG for downhole applications that are particularly power intensive. U.S. Pat. No. 6,348,792 Beard et al. discloses a side-looking NMR logging tool incorporates a permanent magnet arrangement having a magnetization direction oriented towards a side of the tool and a dipole RF antenna displaced towards the front of the tool. The magnet arrangement produces a shaped region of investigation in front of the tool wherein the magnetic field has a uniform field strength and the RF field has a uniform field strength in a direction orthogonal to the static field. NMR tools generally benefit greatly from increasing the power provided to the tool.

Figure 7:
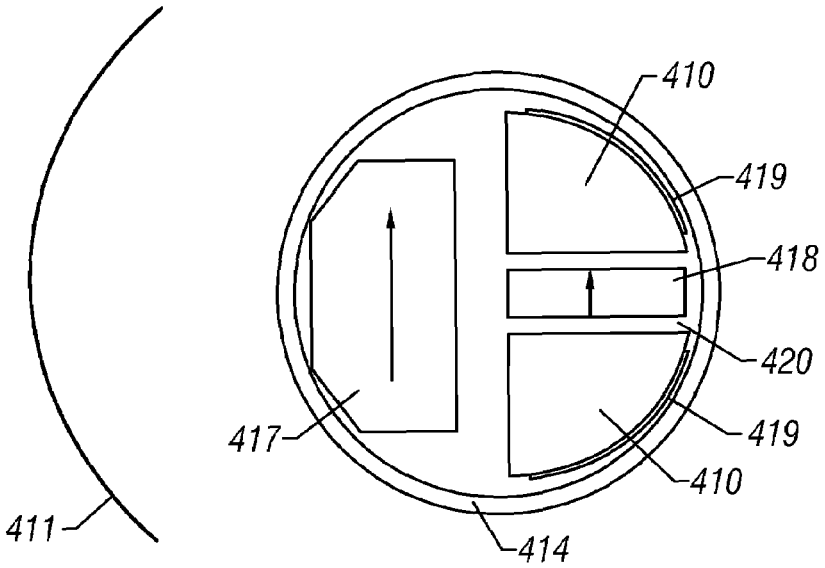
FIG. 7 (Prior Art)
FIG. 7 (prior art) illustrates a NMR instrument for use with the present invention.

FIG. 7 schematically illustrates the device of Beard wherein this shaping of the static and RF fields is accomplished. The tool cross-sectional view in FIG. 7 illustrates a main magnet 417, a second magnet 418, and a transceiver antenna, comprising wires 419 and core material 410. The arrows 421 and 423 depict the polarization (e.g., from the South pole to the North pole) of the main magnet 417 and the secondary magnet 418. A noteworthy feature of the arrangement shown in FIG. 7 is that the polarization of the magnets providing the static field is towards the side of the tool, rather than towards the front of the tool as in prior art devices. The second magnet 418 is positioned to augment the shape of the static magnetic field by adding a second magnetic dipole in close proximity to the RF dipole defined by the wires 419 and the soft magnetic core 410. This moves the center of the effective static dipole closer to the RF dipole, thereby increasing the azimuthal extent of the region of examination, the desirability of which has been discussed above. The second magnet 418 also reduces the shunting effect of the high permeability magnetic core 410 on the main magnet 417: in the absence of the second magnet, the DC field would be effectively shorted by the core 410. Thus, the second magnet, besides acting as a shaping magnet for shaping the static field to the front of the tool (the side of the main magnet) also acts as a bucking magnet with respect to the static field in the core 410. Those versed in the art would recognize that the bucking function and a limited shaping could be accomplished simply by having a gap in the core; however, since some kind of field shaping is required on the front side of the tool, in a preferred embodiment of the invention, the second magnet serves both for field shaping and for bucking. If the static field in the core 410 is close to zero, then the magnetostrictive ringing from the core is substantially eliminated. The device of Beard is for illustrative purposes only, the QTG of the present invention can be used with any downhole NMR tool to increase the power to the antennas.

U.S. Pat. No. 5,473,939 to Leder having the same assignee as the present invention and the contents of which are fully incorporated herein by reference discloses a method and apparatus for conducting in situ tests on a subsurface earth formation of interest which is traversed by a wellbore. A wireline formation testing instrument is positioned at formation depth and a sampling probe thereof is extended into fluid communication with the formation and isolated from wellbore pressure. Utilizing a hydraulically energized double-acting bi-directional piston pump and by valve controlled selection of pumping direction testing fluid such as completion fluid may be pumped into the formation through the sampling probe either from fluid reservoirs of the instrument or from the wellbore. The pumping operation can require significant amounts of power. Hence the QTG of the present invention is suitable for use with formation fluid sampling operations. A MWD implementation of a fluid sampling apparatus is disclosed in U.S. Pat. No. 6,157,893 to Berger et al, having the same assignee as the present invention and the contents of which are incorporated herein by reference.

U.S. Pat. No. 6,788,066 to Wisler et al., having the same assignee as the present invention and the contents of which are fully incorporated herein by reference discloses an apparatus for making resistivity measurements while coring. There are numerous prior art devices for recovering core samples while drilling. See, for example, U.S. Pat. No. 5,957,221 to Hay et al., having the same assignee as the present invention and the contents of which are incorporated herein by reference. The QTG of the present invention may be used to provide additional power to a downhole drilling motor discussed with reference to FIG. 1.

Other downhole tools that would benefit from the power capabilities of the QTG would be resistivity devices. For MWD applications it is useful to be able to measure formation resistivity at some distance from the borehole. This is particularly important in reservoir navigation where it is desired to maintain the borehole at a specified distance relative to a resistivity interface (such as an oil-water contact) away from the borehole. The distance to which a resistivity tool can "see" is a function of the antenna power, so that the QTG would be particularly useful.

Once measurements have been made using the sensors, processing of the acquired data is done using a processor. The processor may be located downhole and may thus be cooled by the quantum thermocooler. When resistivity measurements are made, the processor may determine parameters of the earth formation such as horizontal and vertical resistivities, positions of interfaces such as bed boundaries and fluid contacts, etc. When NMR measurements are made, then parameters of interest that are commonly determined include bound volume irreducible, clay bound water, porosity, distribution of longitudinal relaxation time, distribution of transverse relaxation time, diffusivity, etc. Other types of sensors that may be used include gamma ray sensors, neutron sensors, fluid pressure sampling devices.

Implicit in the control and processing of the data is the use of a computer program implemented on a suitable machine readable medium that enables the processor to perform the control and processing. The machine readable medium may include ROMs, EPROMs, EAROMs, Flash Memories and Optical disks.

While the foregoing disclosure is directed to the specific embodiments of the invention, various modifications will be apparent to those skilled in the art. It is intended that all such variations within the scope and spirit of the appended claims be embraced by the foregoing disclosure.

What is claimed is:

1. A system for use in a borehole, the system comprising:

a downhole assembly configured to be conveyed into the borehole;

a quantum tunneling thermoelectric generator (QTG) configured to produce electrical power in response to a difference of temperature between a first side of the generator and a second side of the generator, and a downhole device operated by the electrical power;

wherein a first side of the QTG is configured to be in thermal contact with an interior of the downhole assembly and a second side of the QTG is configured to be in thermal contact with a fluid between the downhole assembly and a wall of the borehole.

2. The system of claim 1 wherein the borehole is a producing borehole, and wherein the downhole device is selected from (i) a flow control device, (ii) a packer, (iii) a choke, (iv) a perforating device, (v) an anchor, (vi) a completion device, and (vii) a production device.

3. The system of claim 1 further comprising:

(i) a downhole assembly configured to include the QTG; and (ii) a wireline configured to convey the downhole assembly into the borehole.

4. The system of claim 1 further comprising:

(i) a downhole assembly configured to include the QTG; and (ii) a conveyance device configured to convey the downhole assembly into the borehole wherein the conveyance device selected from (A) a drillstring, and (B) coiled tubing.

5. The system of claim 1 further comprising:

(i) a phase change material enclosed within an insulating container, and (ii) a thermally conductive element configured to couple the phase change material to the first side of the QTG.

6. The system of claim 1 wherein the device is selected from the group consisting of: (i) a nuclear magnetic resonance device, (ii) a coring device, (iii) a formation fluid sampling device, and (iv) a resistivity measuring device.

7. The system of claim 1 further comprising a cooling device which cools an electronic component downhole.

8. A method of performing operations in a borehole, the method comprising:

conveying a quantum tunneling thermoelectric generator (QTG) into a borehole on a downhole assembly, a first side of the QTG being in thermal contact with an interior of the downhole assembly and a second side of the OTG being in contact with a fluid between the downhole assembly and a wall of the borehole;

producing electrical power in response to a difference of temperature between the first side of the thermoelectric generator and the second-side of the thermoelectric generator; and operating a downhole device using the electrical power.

9. The method of claim 8 wherein the borehole is a producing borehole, the method further comprising selecting the downhole device from: (i) a flow control device, (ii) a packer, (iii) a choke, (iv) a perforating device, (v) an anchor, (vi) a completion device, and (vii) a production device.

10. The method of claim 8 wherein the QTG is part of a downhole assembly, the method further comprising conveying the downhole assembly into the borehole on a wireline.

11. The method of claim 8 wherein the QTG is part of a bottomhole assembly, the method further comprising conveying the downhole assembly into the borehole on a conveyance device selected from (i) a drilling tubular, and (ii) coiled tubing.

12. The method of claim 11 further comprising:

raising the downhole assembly including a phase change material;

wherein the first side of the QTG comprises an emitter.

13. The method of claim 8 further comprising:

(i) enclosing a phase change material within an insulating container, and (ii) thermally coupling the phase change material to the first side of the QTG.

14. The method of claim 13 further comprising:

lowering a downhole assembly including the phase change material into the borehole;

wherein the first side of the QTG comprises a collector.

15. The method of claim 8 wherein operating the device further comprises operating at least one of: (i) a nuclear magnetic resonance device, (ii) a coring device, (iii) a formation fluid sampling device, and (iv) a resistivity measuring device.

16. The method of claim 8 further comprising using a cooling device for cooling an electronic component downhole.

17. A method of conducting operations in a borehole, the method comprising:

conveying a quantum tunneling thermoelectric generator (QTG) into the borehole;

coupling a phase-change material to only a first side of the QTG in a first mode of operation and coupling the phase-change material to only a second side of the QTG in a second mode of operation;

using a temperature difference between the first side of the QTG and the second side of the QTG to generate electrical power; and operating a downhole device using the generated electrical power.

18. The method of claim 17 wherein the borehole is a producing borehole, and wherein the downhole device is selected from (i) a flow control device, (ii) a packer, (iii) a choke, (iv) a perforating device, (v) an anchor, (vi) a completion device, and (vii) a production device.

19. The method of claim 17 wherein the QTG is part of a bottomhole assembly, the method further comprising conveying the downhole assembly into the borehole on a conveyance device selected from (i) a drilling tubular, and (ii) coiled tubing.

20. The method of claim 17 further comprising:

lowering a downhole assembly including the phase change material into the borehole;

wherein the first side of the QTG comprises a collector.

21. The method of claim 17 further comprising:

raising the downhole assembly including a phase change material;

wherein the first side of the QTG comprises an emitter.

* * * * *

UNITED STATES PATENT AND TRADEMARK OFFICE

CERTIFICATE OF CORRECTION

PATENT NO. : 7,647,979 B2
APPLICATION NO. : 11/087361
DATED : January 19, 2010
INVENTOR(S) : Frederick E. Shipley et al.

It is certified that error appears in the above-identified patent and that said Letters Patent is hereby corrected as shown below:

Column 10, claim 1, line 46, delete “a first”, insert --the first--;

Column 10, claim 1, line 47, delete “assembly and a”, insert --assembly and the--;

Column 11, claim 8, line 15, delete “a borehole”, insert --the borehole--;

Column 11, claim 10, line 30, delete “part of a”, insert --part of the--;

Column 11, claim 11, line 33, delete “part of a”, insert --part of the--;

Column 12, claim 11, line 34, delete “bottomhole”, insert --downhole--; and

Column 12, claim 14, line 2, delete “lowering a”, insert --lowering the--.

Signed and Sealed this

Twenty-first Day of September, 2010

David J. Kappos

David J. Kappos
*Director of the United States Patent and Trademark Office*